US005778559A

United States Patent [19]

Winheim

[11] Patent Number: 5,778,559

[45] Date of Patent: Jul. 14, 1998

[54] DEVICE AND PROCESS FOR MOISTENING A RUNNING MATERIAL WEB

[75] Inventor: Stefan Winheim, Frankfurt, Germany

[73] Assignee: V.I.B. Apparatebau GmbH, Maintal, Germany

[21] Appl. No.: 378,633

[22] Filed: Jan. 26, 1995

[30] Foreign Application Priority Data

Oct. 19, 1994 [DE] Germany ..... 44 37 375.9

[51] Int. Cl.[6] ..... F26B 9/00

[52] U.S. Cl. ..... 34/611; 34/114; 162/202

[58] Field of Search ..... 34/611, 114; 162/202, 162/204, 207

[56] References Cited

U.S. PATENT DOCUMENTS

| | | | |
|---|---|---|---|
| 3,242,587 | 3/1966 | Dupasquier . | |
| 3,337,968 | 8/1967 | Krikorian et al. | 34/634 X |
| 4,351,700 | 9/1982 | Dove . | |
| 4,580,355 | 4/1986 | Boissevain | 162/207 |
| 5,379,526 | 1/1995 | Haverinen | 34/114 |

FOREIGN PATENT DOCUMENTS

| | | |
|---|---|---|
| 1 134 187 | 10/1982 | Canada . |
| 43 36 271 A1 | 3/1994 | Germany . |
| 2 150 163 | 6/1985 | United Kingdom . |

*Primary Examiner*—Henry A. Bennett
*Assistant Examiner*—Pamela A. Wilson
*Attorney, Agent, or Firm*—Darby & Darby

[57] ABSTRACT

A device for the moistening of a running web of material with the aid of stream includes a housing which has a treatment side facing the web of material. The treatment side includes steam exit openings. The device further includes a front side disposed at the incoming end of the treatment side. In the area of the front side, over part of its length in a direction toward the web, a projecting rail is placed over the treatment side and has a working edge that faces toward the web of material.

26 Claims, 2 Drawing Sheets

DEVICE AND PROCESS FOR MOISTENING A RUNNING MATERIAL WEB

BACKGROUND OF THE INVENTION

1. Field of the Invention

The present invention relates to a device for moistening a running web of material by steam exiting from a housing having a treatment side that includes steam exit openings facing the web. The housing has a front side which faces the approaching running web. The invention further relates to a process for moistening a running web with the aid of at least one jet of steam being directed against the web of material.

2. Description of the Related Art

Devices and processes are used in the paper industry for moistening a paper web, prior to the web being guided through the nip of rollers of a roll apparatus. Due to the moistening, various parameters of the paper web, such as sheen and smoothness, can be influenced.

Such a device is shown in DE 43 01 023 A1 which, because of its wedge-like shape, can be placed relatively close to and in front of a nip of rollers of a roll apparatus. The treatment side of such a device does not necessarily have to be planar. In fact, depressions, into which the steam exit openings are placed, can be provided in the device. For reference purposes, the front side of this device faces the direction from which the material web is approaching. When the device is used in connection with a roll apparatus, the front side is the side facing away or remote from the roll apparatus.

The moistening of the web material with steam has proven to be an effective way of evenly moistening the web. However, there are still problems involved. For example, when the steam penetrates the web it must first pass through an air layer clinging to the web material. In most cases, it is important that the moistening is controlled such that the steam will condense after it has penetrated into the web of material and not before. If the steam were to condense before it penetrates into the web, the steam will collect on the web in the form of droplets. One way to achieve an effective steam penetration is to increase the speed or flow rate of the steam so that the energy of the steam is of such a magnitude as to enable the steam to penetrate through the clinging air layer. The higher the desired speed of the steam, the higher the steam pressure has to be, which results in a higher energy expenditure when operating the apparatus. A further disadvantage is created in that the steam is not fully absorbed by the web of material but is partially deflected therefrom and is diffused into the surrounding atmosphere.

SUMMARY OF THE INVENTION

It is an object of the present invention to improve the moistening of a running web of material. This object is achieved by using a device that has a projecting rail disposed in front of the treatment side, especially in the area of the front side, and further extends at least partially in the direction of the web material and over the treatment side. The projecting rail has an edge that extends toward the web of material.

The present invention relates to a one-sided, at least substantially closed, steaming chamber disposed between the device and the web of material. The rail extends to a very small extent in the running direction of the web of material. In an abstract sense, the rail can be described as a sort of line. Thus, the rail can be arranged such that the edge of the rail is closer to the material web than to the device itself. Even though a small gap remains between the web material and the edge, the escape of steam into the surrounding atmosphere is effectively blocked. The small gap will be fluid dynamically influenced by the running web in such a manner that any steam appearing in the area of the gap will instantly be dragged from the front side and in the direction of the treatment side. The edge of the rail has a further possible effect in that because the position of the edge is adjusted to be relatively close to the web of material, there is a peeling effect on the air layer clinging to the web of material such that the air layer is disturbed or even lifted from the web of material. Because of this disturbance to the air layer, the steam located behind the edge can more easily move into the web of material and thereafter condense within the web. The degree of effectiveness of the moistening device according to the present invention is thereby considerably enhanced. Therefore, it is possible to either obtain the same degree of moistening by reducing the amount of moisture expenditure or it is possible to increase the amount of transferable moisture with the same amount of moisture expenditure as before. The latter case is especially important when the speed of the material web increases. The edge of the rail can also be designated as a working-edge, peeling-edge, deflection-edge, tear-off-edge or as a sealing edge.

The rail is preferably adjustably mounted to the housing to allow for adjustment of the distance between the web of material and the edge. This permits for greater tolerance when mounting the moistening device because in many instances it is rather difficult to place the housing in such a manner that the desired narrow distance between the web of material and the housing is obtained. Therefore, because the rail is made adjustable relative to the housing, an initial rough positioning of the housing is sufficient, while the fine positioning of the rail relative to the housing can take place at a later time.

In a preferred embodiment, the edge of the rail is curved normal to the running direction of the web of material and the curve itself is adjustable. In many instances, for example in a calender, a width spreading roller is provided in front of the roll gap. The width spreading roller spreads the web so that the web has its widest possible width before running through the roll gap. The width spreading roller has, at least where the web material contacts the roller, a curved surface. The curvature is obtained by bending the width spreading roller. However, the result is that the web material no longer moves in one plane, but now moves in somewhat of an arc. Thus, the distance from the web material to the housing changes as one moves across the moving web. For example, the distance from the web to the housing is greater in the middle of the web than at the edges. However, when the edge is curved in a manner corresponding to the arc of the moving web, the edge can follow the web in a direction normal (when viewed in cross-section) to the running direction of the web.

There is preferably a constant gap distance between the edge, across its width, and the web of material. Because of the constant gap distance, a rather uniform moistening of the web is obtained. The uniformity of the moistening also allows the steam pressure across the width of the material to be held to substantially the same level. The gap between the web and the edge is of such uniformity that at no one particular location do any fluid currents arise which could influence the steam to form a certain or favored fluid stream which would, perhaps, escape to the outside atmosphere. Furthermore, because of these measures, it is assured that the disturbance of the air layer clinging to the web of material occurs substantially uniformly across the web of material so that as a result, a corresponding uniformity of the moistening of the web by means of the steam is assured.

Preferably, the constant gap distance is held in a range of 2 mm to 12 mm. Within this range, there is on one hand a sufficient distance between the web of material and the edge to minimize the risk of damage to the material web and, on the other hand, the distance is still sufficiently close to prevent the steam from exiting the steam chamber while the edge sufficiently disturbs the air layer which is clinging to the web of material.

The rail is preferably provided with slits which originate from a second edge of the rail which is disposed opposite from the above-mentioned edge. The slits end in holes that have a diameter which is larger than the width of the slits. The rail is formed as a substantially planar body because of its function as a limiting wall for the steaming chamber and can be bent in such a manner as to impart a curve to the edge.

When the rail is bent, the distance between the edges of the slits will change, that is, the slits will get wider or narrower at the originating edge depending on which curvature the edge should follow. The slits can be relatively narrow with a width of about 5 to 8 mm being sufficient for most applications. The distance of the slit from the edge to the end is, preferably, in a range of 10 to 12 mm and the diameter of the holes is preferably about 15 mm. The use of the holes has the advantage that when the rail is bent, any stress distributions created in the material by the bending are distributed around the holes to reduce the risk of creating a crack.

The rail is preferably assembled from two layers of material, where each layer is provided with slits and the slits are arranged off-set from each other. In this manner, it is possible to create a fluid tight limiting wall of the steaming chamber which, however, is still bendable such that a predetermined curvature can be obtained.

Preferably, one of the layers is placed against the housing which is heated at this location. The location where the layer is placed against the housing should be partially planar and the rail should be made from a material having a good heat conductivity, such as is found in copper. Because of the good heat conductivity, the temperature of the housing is quickly and evenly distributed to the rail. This heat is then also transferred to the other material layer. In this manner, the rail is heated by relatively simple means and the forming of condensate on the rail is substantially avoided.

The rail is preferably provided with elongated longitudinal holes through which bolts can be guided to fasten the rail to the front of the housing. The bolts themselves, or nuts provided thereon, can be loosened so that the rail and the curvature at its corresponding edge can be adjusted and thereafter the bolts or the nuts can be retightened. In this manner a simple adjustment is possible, which is especially important since the adjustment can be undertaken while the web of material is disposed in the roll apparatus. Thus, the distance between the edge of the rail and the web of material can be controlled immediately after any adjustments of the machinery have been made. In other words, the position of the edge can always be fitted immediately to the position of the web of material.

The layers of material of the rail are preferably connected to each other at predetermined connection locations such that, in cross-section, at least one slit of each material layer is provided between each connection location. Because of this type of connection, the rail can be handled as a one-piece unit, which, especially when the curvature is being adjusted, makes the handling of the rail easier, while the bendability of the rail is still assured.

The rail, at the area of its edge, is preferably bent in the direction of the running web so that the edge presents itself to the web of material as a curved surface. Thus, the danger of damaging the web of material is drastically minimized because a minimal touching of the edge with the material web can be tolerated, even though this is not necessarily desirable.

In an alternative embodiment, the rail in the area of the edge can be bent in the direction opposite to the incoming web of material, such that it has an angle ranging from 30° to 70°. By using such a formation, the peeling effect of the edge is even further enhanced. The air clinging to the web material is lifted in a planar manner especially when the edge is located relatively close to the web of material. It is desirable here to round off the edge. However, it is essential in this embodiment to maintain a predetermined minimum distance between the edge and the web of material to avoid an unintentional contact with the web of material.

In a preferred embodiment, a second rail is provided at the rear side of the housing. The second rail protrudes toward the treatment side of the web of material and the edge that is directed toward the web of material is adjustable into a curvature. This rail structurally corresponds essentially to the rail that is located on the front side. Such a second rail is needed when the device for moistening the web material is used between a width spreading roller and the roller gap and where the distance from the device to the roller gap is still so great that the material web still has an arc shape. Because of the use of the second rail, the steaming chamber is closed toward the rear, that is, toward the roller gap, so that the uniformity of the steaming is not detrimentally affected and so that the steam can escape more easily in the middle of the web.

The housing also preferably has an at least partially slanted rear side that includes a sealing rail. The construction of such a slanted sealing rail is known from DE 43 01 023 A1. Because of the use of a sealing rail, the steaming chamber disposed between the housing and the web of material can be closed on the rear side. This precludes, or at least makes it more difficult for, steam to escape at this location, so that less steam will escape to the surrounding atmosphere. Furthermore, such a sealing rail also makes it more difficult for air to penetrate into the steaming chamber with its attendant cooling effect, so that less energy for maintaining the desired temperature is needed.

The sealing rail is preferably formed of a lesser abrasive resistant material as compared to the roll. When the roll rubs against the rail, the abrasion resistance is chosen such that no practical changes can be observed on the roll while the sealing rail is abraded rather quickly. Thus, the housing, which is provided with a sealing rail, can be moved into the desired position in front of the roller gap. Because the sealing rail is somewhat over-dimensioned, the roller will then abrade the sealing rail to thereby create a narrow gap between the sealing rail and the roller, without requiring any further adjustments. Once the roller has been initially abraded, the sealing rail will be under no further strain.

It is further preferred that the sealing rail be connected to the housing by a connection that can be quickly changed. Because the sealing rail is a so called wear part, the exchange of the same should be effected with a minimum of effort. The quick change connection could, for example, be formed as a track onto which the rail would be pushed.

The object of the present invention is achieved by, prior to the application of steam, at least partially disturbing or peeling off the air layer clinging to the running web of material. As explained above, in connection with the device, the disturbance of the air clinging to the web of material has the effect that the steam has less resistance to overcome. The steam thus reaches the web of material with a lower speed than was previously required.

Preferably, the web of material is guided so that it forms a part of a limiting gap that is located in front of the fluid stream of steam. The gap itself is adjustable. The gap thereby serves to whirl or to peel off the air layer from the running web. Because the web of material forms a movable limit of the gap, no further measures are necessary to effect a disturbance of the clinging air layer. Since the size of the gap is adjustable, it is now possible to correctly influence the disturbance of the air layer. In determining the size of the gap, various other operating parameters should be considered, such as, for example, the speed of the moving web and the pressure of the steam. The size of the gap is preferably adjustable within a range of 2 mm to 12 mm.

A further advantage of the present invention is that the gap is adjustable in such a manner that it corresponds to the arc of the material. When using a width spreading roller, problems have arisen in attempts to uniformly moisten the web over its entire width, especially in the middle of the web where the distance between the moistening device and the web is the greatest. Typically, in the middle of the web the steam has escaped before it could be applied to the web. This problem has now been eliminated because of the curvature of the edge.

The gap is preferably adjusted to an evenly maintained dimension across the direction of the moving web. A constant gap distance, in a mathematical sense, is not required. It is only necessary to ensure that over the width of the web, no major size differences prevail so that, on one hand the steam will find the fluid conditions across the gap to be substantially the same, and, on the other hand, the disturbance of the air layer clinging to the web of material occurs essentially uniformly everywhere.

It is preferred that the whirling or peeling of the air layer occurs at the beginning or just prior to the gap where the steam pressure is applied counter to the running direction of the web of material. However, the gap is necessary in most cases to avoid damage to or even a tearing of the web of material, which may occur if the running web of material strikes against the treatment device. A small gap, however, can be sealed by corresponding steam pressure which already exists in the treatment chamber when steam is applied to the web of material.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENTS

Figure 1:
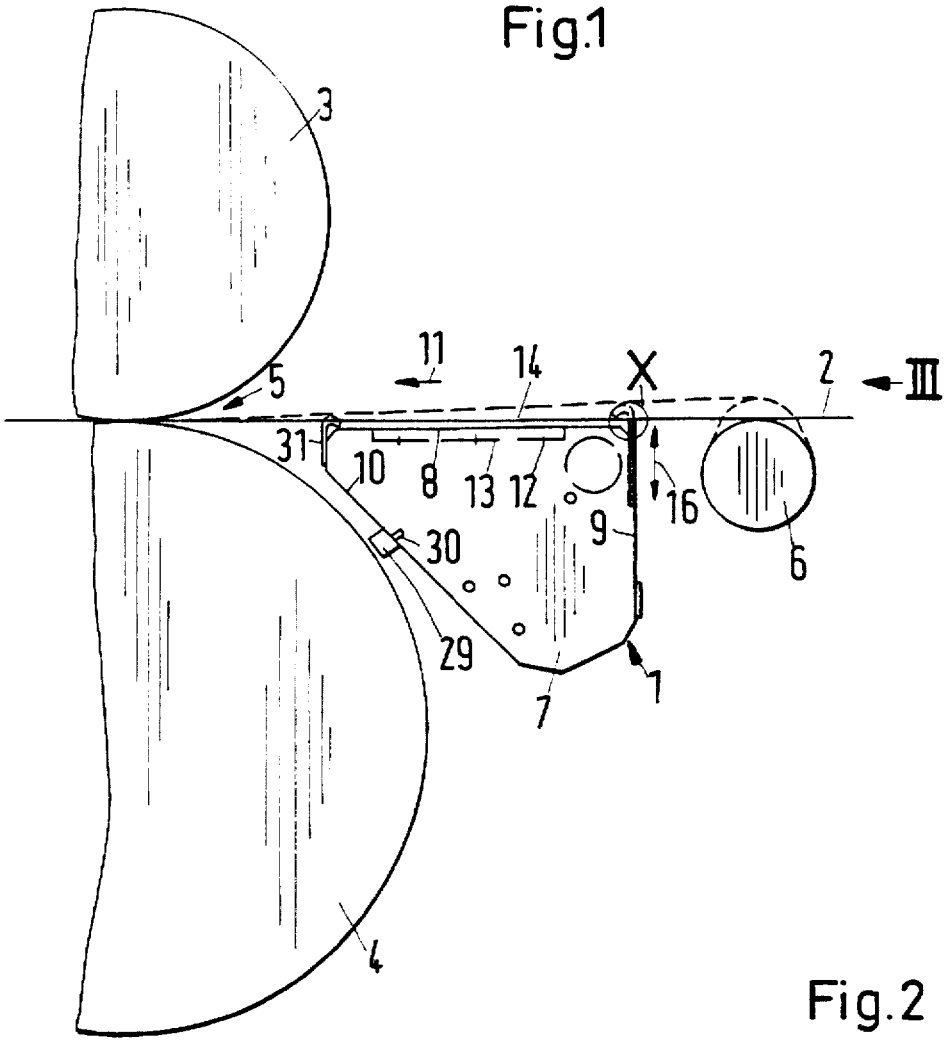
FIG. 1 shows a steaming device disposed in front of a roller gap.
Figure 3:
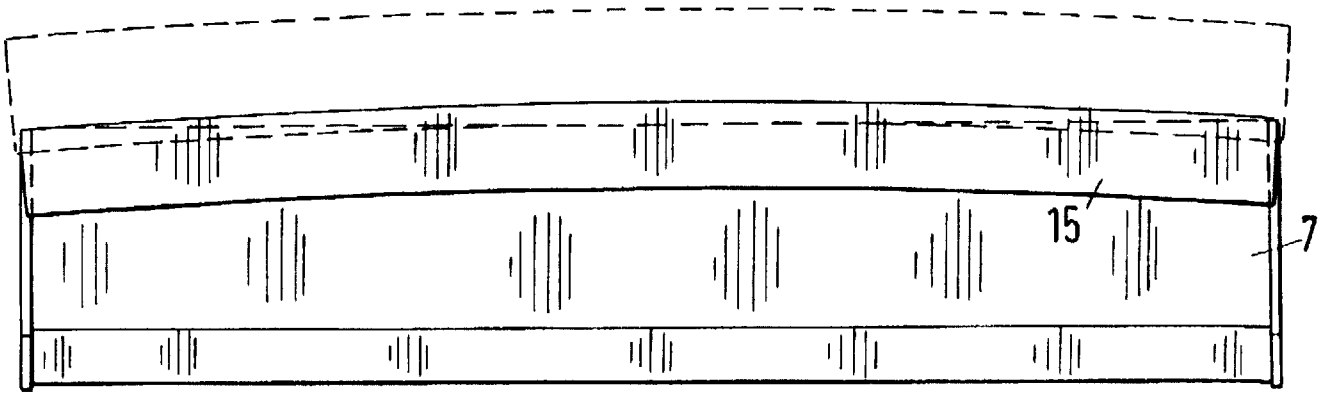
FIG. 3 is a schematic view looking in the direction of arrow III in FIG. 1.

A device 1, used for moistening a running web of material 2, is illustrated in FIG. 1. The web 2 is disposed in a gap 5 formed by two rollers 3 and 4. A width spreading roller 6 is disposed adjacent to the device 1 such that the device 1 is disposed between the gap 5 and the roller 6. The width spreading roller 6 is bent as can be seen in FIG. 3. The web of material, for example a paper web, is also correspondingly arced. As a result, as shown in dashed lines, the middle, in a lateral extent, is lifted higher than the edges. This arcing of the running web diminishes in the direction of the gap 5, at which point the web of material is in a completely planar state.

The device 1 consists of a housing 7, which includes a treatment side 8, a front side 9, and a back side 10. As the web of material 2 is running in the direction of arrow 11 from the width spreading roller 6 to the roller gap 5, the front side 9 faces the incoming web of material.

At the treatment side 8, steam exit openings 12 are provided, as shown schematically in FIG. 1. The treatment side 8 does not have to be formed as a planar wall. In fact, the steam exit openings can be arranged in depressions 13, as is known from DE 43 01 023 A1. A steaming chamber 14 is disposed between the treatment side 8 and the web of material 2. A rail 15 is provided on the front side of the housing. The rail is movable in the direction of double arrow 16. The rail 15 has an edge 17 which, by moving the same in the direction of the double arrow 16, can be moved closer to or further away from the web of material.

Figure 2:
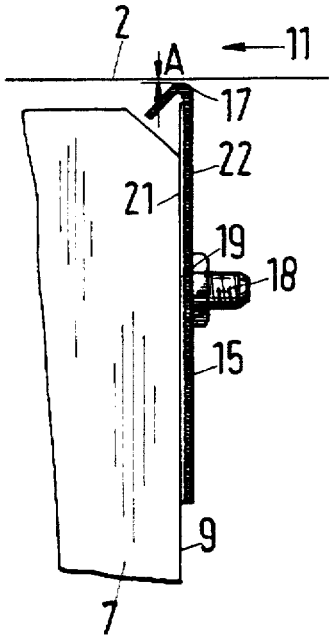
FIG. 2 shows the detail of circle X in FIG. 1.

The edge 17 is bent toward the treatment side. That is, edge 17 is bent in the moving direction 11 of the web of material 2 as illustrated in FIG. 2. The rail 15 is, through the aid of bolts 18 and nuts 19, fastened to the front side 9 of the housing 7. The bolts can pass through longitudinal elongated holes 20 in the rail (see FIGS. 4 and 5). After a nut 19 is loosened, the rail 15 can be moved in the direction of double arrow 16. A gap A is formed between the edge 17 and the web of material 2.

The rail consists of two layers of material, that is, a sheet of copper 21 and a sheet 22 of stainless steel. The sheet of copper 21 abuts against the housing 7 in a planar manner. The housing 7 is heated at least at this location. Thus, the heat is transferred to the sheet of copper 21. The sheet of copper 21 further transfers heat to the sheet of stainless steel 22, so that the rail 15 reaches a state of elevated temperature and the deposit of condensate on the rail 15 can be reliably avoided.

Figure 4:
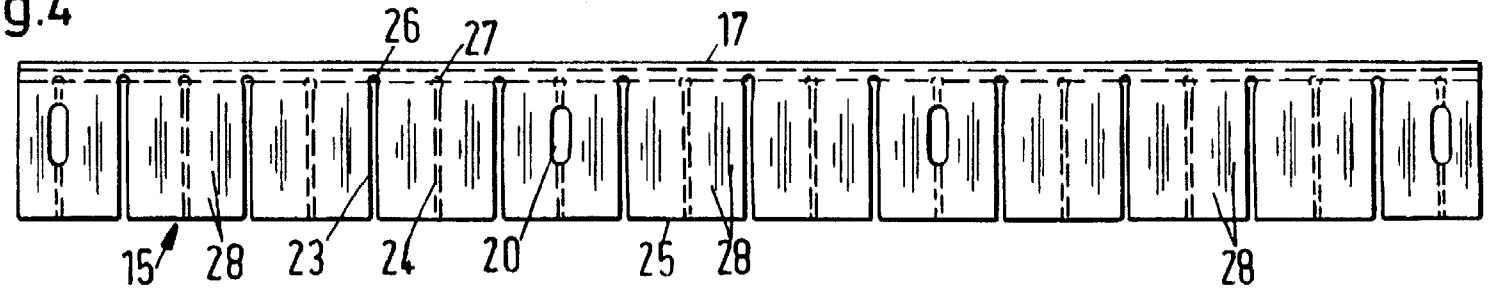
FIG. 4 shows a rail.
Figure 5:
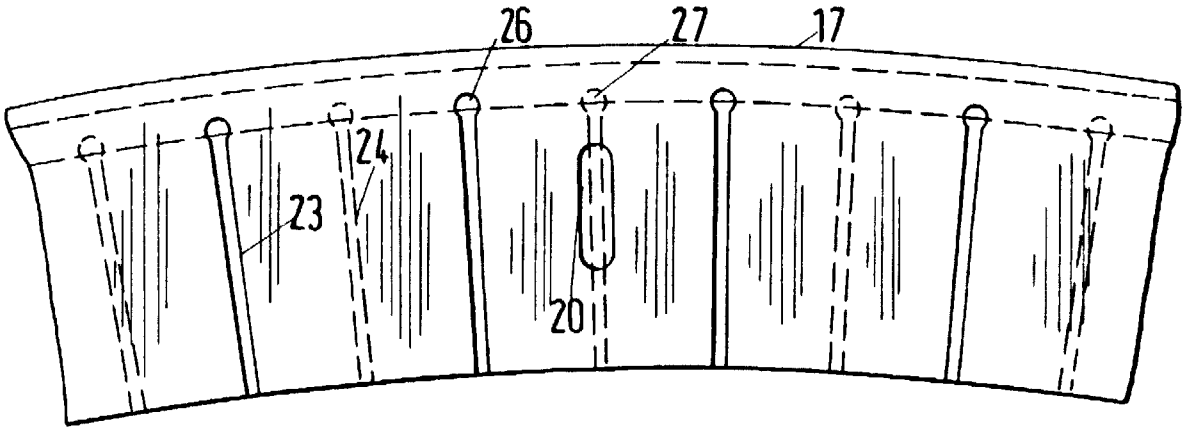
FIG. 5 shows the rail in a curved state.

In FIG. 4, a top view of the rail 15 is illustrated. The sheet 22 of stainless steel is shown in solid lines, while the sheet of copper 21 is shown in dashed lines. As can be seen, both sheets 21 and 22 are provided with slits 23 and 24, respectively, which originate on the longitudinal edge 25 of the rail 15, which is opposed to the edge 17. The slits 23 of the sheet of stainless steel 22 and the slits 24 of the copper sheet 21 are arranged to be offset from each other so that the sheet 22 of stainless steel covers the slits 24 of the copper sheet 21, while the sheet 21 of copper covers the slits 23 of the sheet 22 of stainless steel. The slits 23 and 24 preferably have a width in a range of 5 mm to 10 mm. Slits 23, 24 occupy almost the entire width of the individual sheets 21 and 22. In the area of the edge 17, a web remains, preferably having a height of about 10 mm to 15 mm. The slits 23, 24 end in bores 26, 27 preferably having enlarged diameters of about 15 mm. Because of this arrangement, it is possible to bend the rail 15 in its own plane so that a curved edge is created, which is shown in FIG. 5 in an enlarged view and with a greatly exaggerated curvature.

As can be seen from FIG. 3, the curvature of the rail 15, or to be more exact, the curvature of the edge 17, can be adjusted such that it corresponds to the arc of the web of material 2, which arc is induced by the width spreading roller 6.

The sheet of copper 21 and the sheet of stainless sheet 22 are connected to each other by spot-welds 28. The spot-welds 28 merely serve the purpose of holding the sheets together so that they can be handled as a unit. The final fixing together of the two sheets 21, 22, occurs through the use of the bolts 18 and the nuts 19. Therefore, the spot-welds are disposed at great distances with respect to each other. The distances are chosen such that, in a lateral direction between two adjacent spot-welds, there are at least a pair of slits provided. In the illustrated embodiment, four pairs of slits are disposed between adjacent spot-welds 28. Thus, in spite of connecting the two sheets 21 and 22 together by spot-welding, the desired curvature can be achieved and adjusted, if necessary.

On the rear side 10 of the housing, a second rail 31 is provided which also protrudes over the treatment side 8 of the web of material. The rail 31 structurally corresponds to the structure of rail 15. That is, the edge adjacent to the web of material is curved and the curvature is adjustable in such a manner that it corresponds to the arc of the web which is induced by the width spreading roller 6.

The rear side 10 of the housing 7 is at least partially inclined, and alternatively or additionally, a sealing rail 29 is provided on the rear side. Sealing rail 29 is pushed onto a rod 30 in the housing 7 and, therefore, can be easily and quickly exchanged. In operation, the sealing rail 29 is adjacent to the housing of neighboring roll 4. The rail 29 consists of a low abrasion resistant synthetic material. In other words, rail 29 is formed as a so-called wear part. The sealing rail 29 is installed with an over-tolerance so that when the device 1 is brought into an operating state, roll 4 abrades the sealing rail 29 to the desired shape without damaging the same. Thus, the steaming chamber 14 is also essentially sealed on its rear side.

Figure 6:
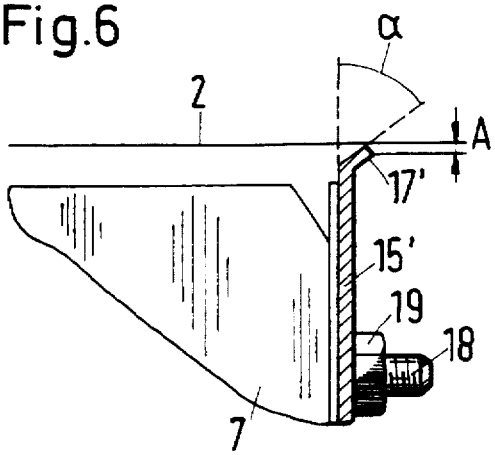
FIG. 6 shows an alternative embodiment of a rail.

FIG. 6 shows an alternative embodiment of a rail 15', wherein the parts corresponding to the parts in the FIGS. 1 to 5 embodiment have the same reference numerals. However numerals of the parts that have been changed have been primed. The only change from FIGS. 1 to 5 is that the rail 15' is not bent in the direction of the running web material, as in the case in FIG. 2, but the edge is now angled against the direction of the running web of material. The edge is preferably bent at an angle of 30° to 70°. The choice of the exact angle depends on, among other things, the desired speed of the web of material. With such a construction, a better peeling effect can be obtained. The air layer which is clinging to the running web can be directly lifted off by edge 17', which forms a wedge. Because a certain minimal distance A in a range of 3 mm to 10 mm has to be maintained, this lifting off of the air layer is further aided by the steam pressure which forms at the rear side of rail 15'.

Having described the presently preferred exemplary embodiments of a new and improved device for moistening a running web of material in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What I claim is:

1. A device for moistening a running web of material comprising:

a housing having a front side, facing said approaching web of material, and a treatment side, said treatment side having a plurality of stream exit openings; and a rail connected to said front side of said housing, said rail having a first edge projecting beyond said treatment side of said housing toward said web of material;

wherein said web of material is arced in a direction transverse to the direction of travel of the web and at least said first edge of said rail is curved in the plane of said rail to correspond to the arc of said web of material.

2. A device according to claim 1, wherein said rail is adjustably connected to said housing so that the distance between said web of material and said first edge is adjustable.

3. A device according to claim 2, wherein said distance between said web of material and said first edge is maintained at a constant distance across a width of the web material.

4. A device according to claim 1, wherein said constant distance between said web of material and said first edge is in a range of 2 mm to 12 mm.

5. A device according to claim 2, wherein said rail has slits which originate from a second edge of said rail that is disposed opposed to said first edge, and said slits end in holes whose diameters are greater than a width of said slits.

6. A device according to claim 5, wherein said rail includes at least two layers of material, each of said layers of material having slits and said slits from one of said layers are offset with respect to said slits of the other of said layers.

7. A device according to claim 6, wherein one of said layers abuts against said housing in planar manner so that good heat conductivity occurs between said housing and said one layer.

8. A device according to claim 6, wherein said layers of material are connected to each other at predetermined connection locations, at least one of said slits of each of said layers of material being disposed between an adjacent pair of said connection locations.

9. A device according to claim 1, wherein said first edge is curved in a direction normal to running direction of said web of material, said device further comprising means for adjusting a curvature of said first edge.

10. A device according to claim 1, wherein said rail has a plurality of longitudinal holes to receive a bolt running therethrough to fasten said rail to said front side of said housing, each hole adapted to receive a bolt running therethrough to fasten said rail to said front side of said housing.

11. A device according to claim 1, wherein said rail is bent in the area of said first edge in a direction corresponding to a movement of said web of material.

12. A device according to claim 1, wherein said rail is bent in a direction corresponding to a direction opposite from the movement of said web of material, said rail being bent at an angle ranging from of 30° to 70°.

13. A device according to claim 1, wherein said housing has a rear side, a second rail being connected to said rear side of said housing, said second rail having an edge projecting beyond said treatment side of said housing toward said web of material, said edge having a curvature that is adjustable.

14. A device according to claim 1, wherein said housing has a rear side at least partially inclined to run along an adjacent roller, a sealing rail being connected to said rear side.

15. A device according to claim 14, wherein said sealing rail is made of a material having a low resistance to abrasion.

16. A device according to claim 15, wherein said sealing rail is removably connected to said housing by a connection that facilitates exchanging of said sealing rail.

17. A device according to claim 1, further comprising means for adjusting the curvature of said first edge of said rail.

18. A device according to claim 17, wherein said means for adjusting the curvature of said first edge of said rail comprises a plurality of slits in said rail originating from a second edge of said rail that is disposed opposed to said first edge.

19. A device for moistening a running web of material comprising:

a housing having a front side, facing said approaching web of material, and a treatment side, said treatment side having a plurality of steam exit openings; and a rail connected to said front side of said housing, said rail having a first edge projecting beyond said treatment side of said housing toward said web of material, wherein said rail is adjustably connected to said housing so that the distance between said web of material and said first edge is adjustable and maintained at a constant distance from said web of material, wherein said web of material is arced transversely and said first edge of said rail is curved to maintain a constant distance across the width of said web of material.

20. A device for moistening a running web of material comprising:

a housing having a front side, facing said approaching web of material, and a treatment side, said treatment side having a plurality of steam exit openings; and a rail connected to said front side of said housing, said rail having a first edge projecting beyond said treatment side of said housing toward said web of material and a second edge opposed to said first edge, said rail further including slits which originate from said second edge of said rail.

21. A device according to claim 20, wherein said rail is adjustably connected to said housing so that the distance between said web of material and said first edge is adjustable.

22. A device according to claim 20, wherein said slits end in holes whose diameters are greater than a width of said slits.

23. A device according to claim 20, wherein said rail includes at least two layers of material, each of said layers of material having slits, said slits from one of said layers being offset with respect to said slits of the other of said layers.

24. A device according to claim 23, wherein one of said layers abuts against said housing in planar manner so that good heat conductivity occurs between said housing and said one layer.

25. A device according to claim 23, wherein said layers of material are connected to each other at predetermined connection locations, at least one of said slits of each of said layers of material being disposed between an adjacent pair of said connection locations.

26. A device for moistening a running web of material comprising:

a housing having a front side, facing said approaching web of material, and a treatment side, said treatment side having a plurality of steam exit openings; and a rail connected to said front side of said housing, said rail having a first edge projecting beyond said treatment side of said housing toward said web of material and set at a fixed distance away from said web of material, wherein said rail is adjustably connected to said housing so that the distance between said web of material and said first edge is adjustable, said rail has slits which originate from a second edge of said rail that is disposed opposed to said first edge, and said slits end in holes.

* * * * *